US006067818A

United States Patent [19]

Winkler

[11] Patent Number: 6,067,818

[45] Date of Patent: May 30, 2000

[54] MOUNT FOR A GEM

[75] Inventor: Wilhelm Winkler, Kolsassberg, Austria

[73] Assignee: D. Swarovski & Co., Wattens, Austria

[21] Appl. No.: 09/107,318

[22] Filed: Jun. 30, 1998

[30] Foreign Application Priority Data

Jul. 4, 1997 [AT] Austria ..... 1154/97

[51] Int. Cl.[7] ..... A44C 17/02

[52] U.S. Cl. ..... 63/26; 63/28; 63/29.1

[58] Field of Search ..... 63/26, 27, 28, 63/29.1, 30, 31, 32

[56] References Cited

U.S. PATENT DOCUMENTS

| | | | |
|---|---|---|---|
| 2,141,363 | 12/1938 | Rigollet | 63/29.1 |
| 2,436,120 | 2/1948 | Pfeffer . | |
| 4,972,685 | 11/1990 | Poll | 63/26 |
| 5,218,839 | 6/1993 | Udko | 63/29.1 X |
| 5,365,754 | 11/1994 | Nalbandian . | |
| 5,432,988 | 7/1995 | Woo | 63/26 X |
| 5,761,780 | 6/1998 | Magi | 63/26 X |

FOREIGN PATENT DOCUMENTS

| | | | |
|---|---|---|---|
| 2719378 | 6/1978 | Germany . | |
| 27 43 164 | 10/1978 | Germany . | |
| 3510200 | 9/1986 | Germany . | |
| 3844599 | 1/1990 | Germany . | |
| 893567 | 12/1981 | U.S.S.R. | 63/26 |
| 826492 | 1/1960 | United Kingdom . | |
| 2 218 319 | 11/1989 | United Kingdom . | |

*Primary Examiner*—Terry Lee Melius
*Assistant Examiner*—William L. Miller
*Attorney, Agent, or Firm*—Wenderoth, Lind & Ponack, L.L.P.

[57] ABSTRACT

A mount for fixing a gem into a through-hole of a thin-walled carrier includes a band curved in an annular shape. The band has a cylindrical area of contact with the through-hole. A lower edge area of the band is conically tapered towards a central axis of the annular band. The band has at least one notch at least in the lower edge area.

19 Claims, 2 Drawing Sheets

MOUNT FOR A GEM

BACKGROUND OF THE INVENTION

The present invention relates to a mount for fixing a gem in a through-hole of a thin-walled carrier, the mount including a band curved in an annular manner.

Such a mount is already known from DE 38 44 599. That discloses a mount which is preferably used for anchoring large glass crystal pieces, wherein with this type of application there are relatively minor requirements with respect to clearance-free retention of the mounted glass piece in the through-hole of the carrier. Even where narrow fits are required because of the size of the mounted glass piece, in order to provide problem-free positioning of the mount in the through-hole it is sufficient to somewhat flatten down the lower edge of the band.

Significantly greater demands are, however, made when such a mount for fixing tiny gems, for example, cut diamonds or cut glass pieces, is to be used in the wall of a jewelry blank with a thickness of only a few tenths of a millimeter. As in this case clearance-free fixing of the mount and gem is absolutely necessary, very narrow fits have to be possible. This gives rise to the problem that the mounted gems, which are difficult to handle because of their small size, cannot easily be placed in the through-hole provided for that purpose.

SUMMARY OF THE INVENTION

The object of the invention is therefore to improve the known mount to the extent that the fitting of the mounted gems in the through-hole of a thin-walled carrier is made easier.

This is solved in accordance with the invention in that the band is cylindrically shaped in the area of contact with the through-hole, and the lower edge area or rim of the band is tapered conically towards the central axis, wherein at least in the lower edge area, the band is provided with at least one notch.

By means of these features, on the one hand a well-filled contact of the mount in the cylindrically shaped area is obtained. On the other hand the conically tapered edge area forms an insertion incline, the effect of which is increased in that at least the lower edge area is divided into a plurality of flexible tongues by means of at least one notch.

If only one notch is provided, it forms, together with the abutting edges of the band formed into a ring, extending parallel to the direction of the central axis of the mount, exactly two flexible tongues.

A preferred embodiment of the insertion incline provides that the lower edge area is inclined in a conical manner.

In order to fix the mount in the through-hole of the thin-walled carrier, it can further be provided that the band is provided with outwardly pointing locking projections. When fitted, these locking projections grip behind the wall of the carrier in a form-fitting manner.

BRIEF DESCRIPTION OF THE DRAWINGS

Further features and details will be evident from the following description taken with the drawings.

In these is shown, in.

DETAILED DESCRIPTION OF THE INVENTION

Figure 1:
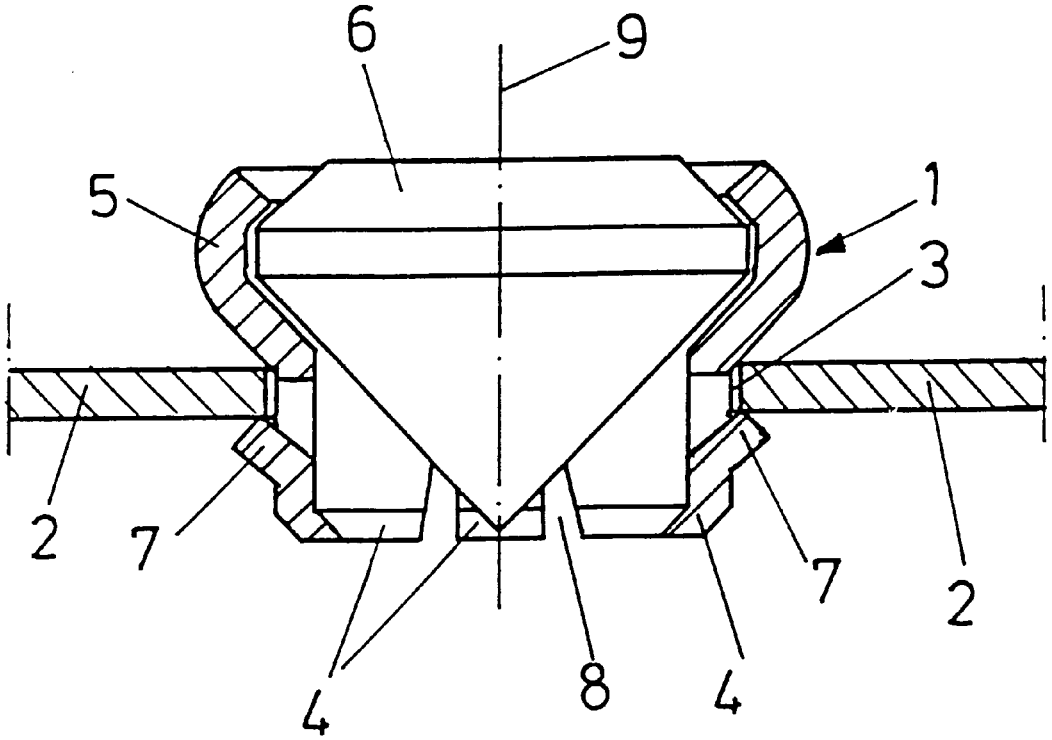
FIG. 1 a section through a mount according to the invention when set.
Figure 2:
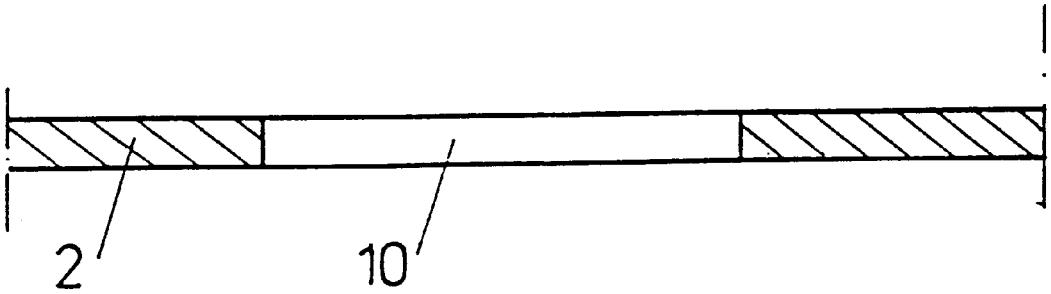
FIG. 2 a through-hole in the wall of a jewellery blank prepared for receiving the mount, FIG. 3 the band forming the mount in the flat state during manufacture, and FIG. 4 a section through a jewellery blank provided with mounted gems.

The fitting of a gem (stone) 6 by means of a mount according to the invention is described simply with reference to FIGS. 1 and 2. A thin walled carrier 2, preferably a jewellery blank with a wall thickness of approximately 0.2 mm has a through-hole 10 for this purpose. In the illustrated embodiment, shown enlarged, the diameter of the cylindrical through-hole 10 is 1.9 mm.

The gem 6 is surrounded by a band 1 curved in an annular manner, wherein in particular the upper edge area or rim 5 of the band 1 surrounds the gem 6 in a form-fitting manner. It is also conceivable, as an alternative, that the gem 6 is fixed by means of retaining clips projecting from the upper edge area 5. The term "gem" should be interpreted very broadly in this context, so that both precious stones and cut (coloured) glass are covered by such term.

Assuming a horizontal setting position according to FIG. 1, the mount formed by the band 1 is pressed from above into the through hole 10. The lower edge area or rim of the band 1 tapers conically inwards and acts as a centering aid and facilitates the positioning of the mount. As the diameter of cylindrically configured contact area 3 of the band 1 substantially corresponds in size with the through-hole 10, the setting of the mount is additionally facilitated in that the lower half of the mount can be compressed in a flexible manner because of the notches 8 defining resilient tongues 4 in the material of the lower rim.

The mount is pushed into the through-hole 10 until locking projections 7 pointing outwards from the band l, which are pushed down during the insertion of the mount, grip behind the thin-walled carrier 2 in a form-fitting manner, i.e. carrier 2 is gripped or clamped between projections 7 and rim 5. The locking projections 7 need not be flattened, however, in contrast to the prior art, as they can spread towards the central axis together with the flexible tongues 4 supporting them. As both the through-hole 10 and the contact area 3 of the band 1 are configured cylindrically, the mount retaining the gems 6 fills the hole well. Slight deviations in size within manufacturing tolerances can moreover be compensated for in that the annular mount is manufactured from a band 1 and consequently is provided with a continuous slit in the direction of the central axis 9.

Figure 3:
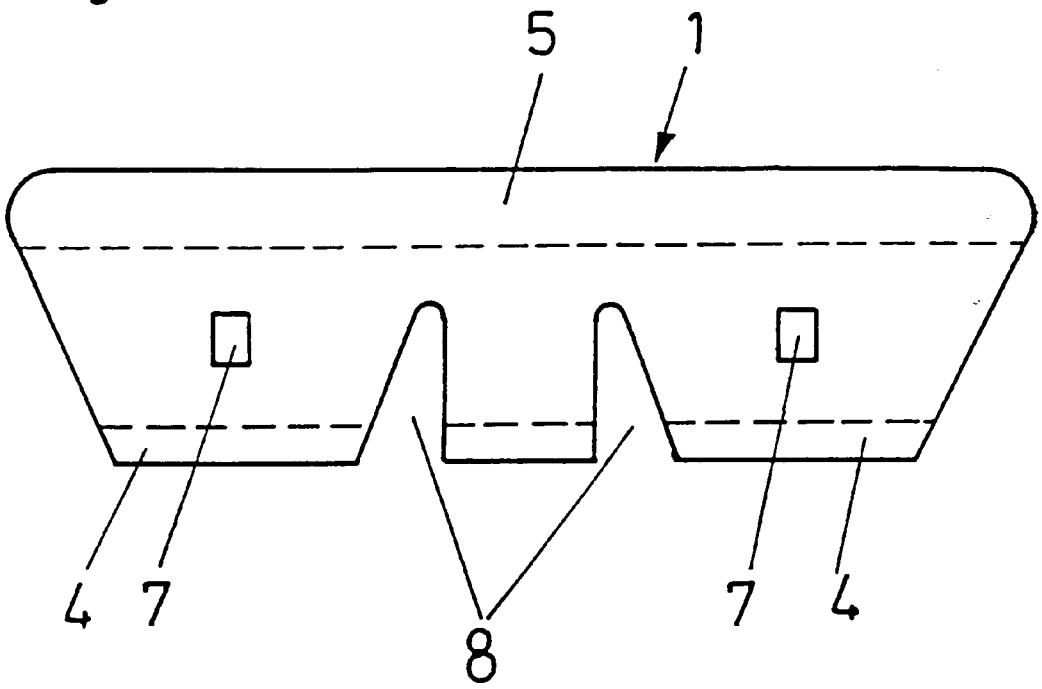

FIG. 3 shows the band 1 when flat. It can be easily manufactured from a metal sheet by stamping and pressing. Brass, tombac, gold and silver are used as preferred metals.

Figure 4:
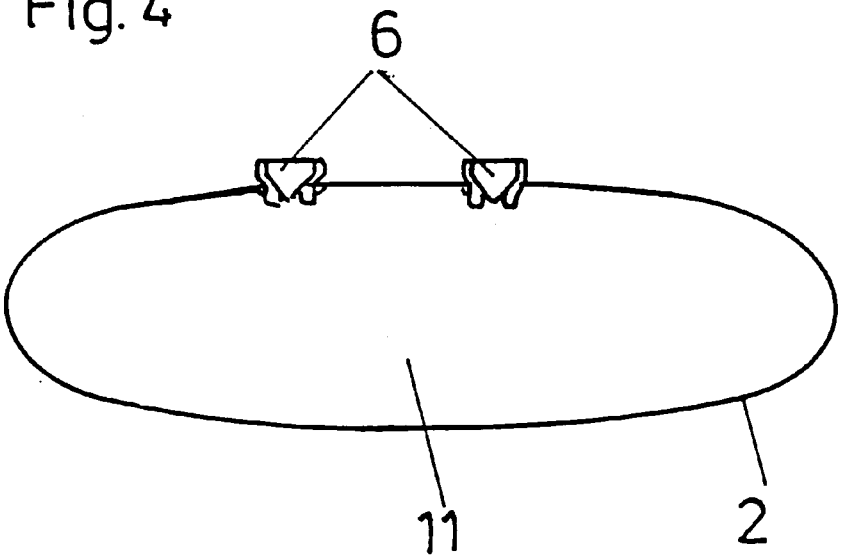

Lastly, in FIG. 4 there is shown in section another jewellery blank in which two gems 6 are set using mounts according to the invention. In this case, the through-holes 10 made in the jewellery blank extend from the outside into cavity 11 of the jewellery blank.

What is claimed is:

1. A mount for mounting a gem onto a thin-walled carrier having therein a through-hole, said mount comprising:

a band formed into an annular shape and having a central axis;

said band having an upper edge area to grip the gem and to be positioned on a first side of the carrier, a conically tapered lower edge area to be positioned on an opposite second side of the carrier, and a central cylindrical area between said upper edge area and said lower edge area and to fit within the through-hole of the carrier;

said band having therein at least one notch extending from said lower edge area toward said upper edge area; and said lower edge area having at least two resilient tongues having extending radially outwardly therefrom projections operable, upon insertion of said mount into the through-hole of the carrier, to cause said resilient tongues to deflect radially inwardly and, upon insertion of said mount by such an extent that said projections have passed through the through-hole, to enable said resilient tongues to deflect radially outwardly, such that the carrier is clamped between said upper edge area and said projections.

2. A mount as claimed in claim 1, wherein said band has therein a plurality of said notches defining a plurality of said resilient tongues.

3. A mount as claimed in claim 2, wherein at least some of said resilient tongues have respective said projections.

4. A mount as claimed in claim 1, wherein said band has therein more than two said notches defining more than two of said resilient tongues.

5. A mount as claimed in claim 4, wherein at least some of said resilient tongues have respective said projections.

6. A mount as claimed in claim 1, wherein said projections are stamped from the material of said band.

7. A mount as claimed in claim 6, wherein said projections are inclined outwardly and toward said upper edge area.

8. A mount as claimed in claim 1, wherein said projections are inclined outwardly and toward said upper edge area.

9. A piece of jewelry comprising:

a gem;

a thin-walled carrier having therein a through-hole;

a mount for mounting said gem onto said carrier, said mount comprising:

a band formed into an annular shape and having a central axis;

said band having an upper edge area gripping said gem and positioned on a first side of said carrier, a conically tapered lower edge area positioned on an opposite second side of said carrier, and a central cylindrical area between said upper edge area and said lower edge area and positioned within said through-hole of said carrier;

said band having therein at least one notch extending from said lower edge area toward said upper edge area; and said lower edge area having at least two resilient tongues having extending radially outwardly therefrom projections operable, upon insertion of said mount into said through-hole of said carrier, to cause said resilient tongues to deflect radially inwardly and, upon insertion of said mount by such an extent that said projections have passed through said through-hole, to enable said resilient tongues to deflect radially outwardly; and said carrier being clamped between said upper edge area and said projections.

10. A piece of jewelry as claimed in claim 9, wherein said band has therein a plurality of said notches defining a plurality of said resilient tongues.

11. A piece of jewelry as claimed in claim 10, wherein at least some of said resilient tongues have respective said projections.

12. A piece of jewelry as claimed in claim 9, wherein said band has therein more than two said notches defining more than two said resilient tongues.

13. A piece of jewelry as claimed in claim 12, wherein at least some of said resilient tongues have respective said projections.

14. A piece of jewelry as claimed in claim 9, wherein said projections are stamped from the material of said band.

15. A piece of jewelry as claimed in claim 14, wherein said projections are inclined outwardly and toward said upper edge area.

16. A piece of jewelry as claimed in claim 9, wherein said projections are inclined outwardly and toward said upper edge area.

17. A piece of jewelry as claimed in claim 9, wherein said through-hole has a diameter of from 1.0 mm to 4.0 mm.

18. A piece of jewelry as claimed in claim 9, wherein said carrier has a wall thickness of from 0.1 mm to 0.4 mm.

19. A piece of jewelry as claimed in claim 9, wherein said carrier is hollow.

* * * * *